US011188108B2

(12) United States Patent
Kidambi et al.

(10) Patent No.: US 11,188,108 B2
(45) Date of Patent: Nov. 30, 2021

(54) MINIMIZING POWER CONSUMPTION IN A DATA ACQUISITION PATH

(71) Applicant: Cirrus Logic International Semiconductor Ltd., Edinburgh (GB)

(72) Inventors: Sunder Kidambi, Austin, TX (US); Mohit Sood, Austin, TX (US); Roderick D. Holley, Austin, TX (US); John C. Tucker, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/984,880

(22) Filed: Aug. 4, 2020

(65) Prior Publication Data

US 2021/0055754 A1 Feb. 25, 2021

Related U.S. Application Data

(60) Provisional application No. 62/888,737, filed on Aug. 19, 2019.

(51) Int. Cl.
*G05F 1/625* (2006.01)
*H04R 3/00* (2006.01)

(52) U.S. Cl.
CPC ..... *G05F 1/625* (2013.01); *H04R 3/00* (2013.01)

(58) Field of Classification Search
None
See application file for complete search history.

(56) References Cited

U.S. PATENT DOCUMENTS 7,092,644 B2 * 8/2006 Davidson ..... G01M 11/33 398/202
7,365,665 B2 * 4/2008 Pease ..... H04B 10/66 341/137
7,620,331 B2 * 11/2009 Schrodinger ..... H04B 10/66 398/202
8,055,139 B2 * 11/2011 Noya ..... H04B 10/66 398/210
8,896,950 B1 * 11/2014 Polley ..... G11B 5/6011 360/46
9,806,685 B1 * 10/2017 Hansen ..... H03F 1/34

* cited by examiner

*Primary Examiner* — Jeffery S Zweizig
(74) *Attorney, Agent, or Firm* — Jackson Walker L.L.P.

(57) ABSTRACT

A data acquisition system may include an input for receiving an input signal for the data acquisition system, a plurality of data paths including a first data path and a second data path, and a signal estimator configured to determine a magnitude of the input signal using estimation of the input signal and dynamically deactivate one of the first and second data paths based on the magnitude of the input signal.

9 Claims, 12 Drawing Sheets

MINIMIZING POWER CONSUMPTION IN A DATA ACQUISITION PATH

RELATED APPLICATIONS

The present disclosure claims priority to U.S. Provisional Patent Application Ser. No. 62/888,737, filed Aug. 19, 2019, which is incorporated by reference herein in its entirety.

FIELD OF DISCLOSURE

The present disclosure relates in general to signal processing systems, and more particularly, to multiple path signal processing systems.

BACKGROUND

Data acquisition systems have wide applications including but not limited to microphone applications and systems. Data acquisition systems (including but not limited to analog-to-digital converter (ADC) systems) receive input signal (s) that are representative or reflective of their environment. These data acquisition systems acquire these signals in a manner that allows them to be further utilized and processed. A data acquisition system may have multiple data paths Enhanced dynamic range and performance of a data acquisition system is desirable. For example, dynamic range/performance of a data acquisition system, such as a microphone or codec using two paths, may be enhanced by one path being optimized for noise floor and the other path being optimized for large signals. On the other hand, another desire for a data acquisition system is to also save power or minimize power consumption. However, there is generally a tradeoff between enhancing dynamic range/performance of a data acquisition system and minimizing/reducing power consumption.

SUMMARY

In accordance with the teachings of the present disclosure, certain disadvantages and problems associated with implementation of multiple data paths in a data acquisition system may be reduced or eliminated.

In accordance with embodiments of the present disclosure, a method for minimizing power consumption in a data acquisition system having a plurality of data paths including a first data path and a second data path may include receiving an input signal for the data acquisition system, determining a magnitude of the input signal using estimation of the input signal, and dynamically deactivating one of the first and second data paths based on the magnitude of the input signal.

In accordance with these and other embodiments of the present disclosure, a data acquisition system may include an input for receiving an input signal for the data acquisition system, a plurality of data paths including a first data path and a second data path, and a signal estimator configured to determine a magnitude of the input signal using estimation of the input signal and dynamically deactivate one of the first and second data paths based on the magnitude of the input signal.

In accordance with these and other embodiments of the present disclosure, a system for minimizing power consumption in a data acquisition system having a plurality of data paths including a first data path and a second data path may include an input for receiving an input signal for the data acquisition system and a signal estimator configured to determine a magnitude of the input signal using estimation of the input signal and dynamically deactivate one of the first and second data paths based on the magnitude of the input signal.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are explanatory examples and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
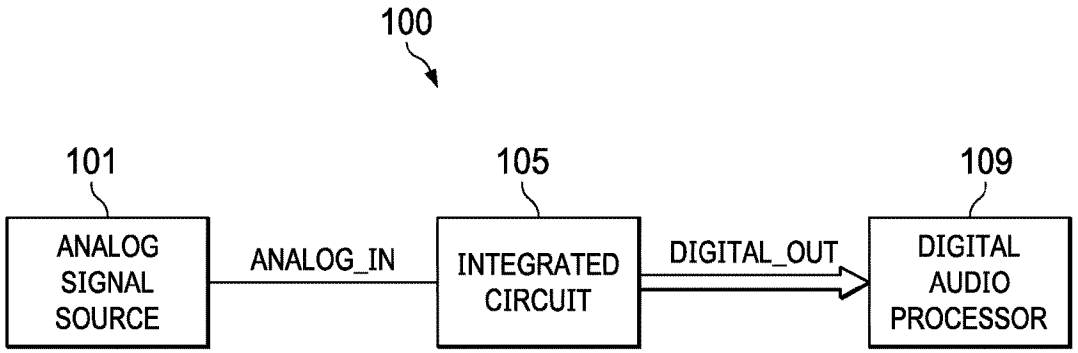
FIG. 1 illustrates a block diagram of selected components of an example data acquisition system, in accordance with embodiments of the present disclosure.

FIG. 1 illustrates a block diagram of selected components of an example data acquisition system 100, in accordance with embodiments of the present disclosure. As shown in FIG. 1, data acquisition system 100 may include an analog signal source 101, an integrated circuit (IC) 105, and a digital processor 109. Analog signal source 101 may comprise any system, device, or apparatus configured to generate an analog electrical signal, for example an analog input signal ANALOG_IN. For example, in embodiments in which data acquisition system 100 is a processing system, analog signal source 101 may comprise a microphone transducer or sensor.

Integrated circuit 105 may comprise any suitable system, device, or apparatus configured to process analog input signal ANALOG_IN to generate a digital output signal DIGITAL_OUT and condition digital output signal DIGITAL_OUT for transmission over a bus to digital processor 109. Once converted to digital output signal DIGITAL_OUT, the signal may be transmitted over significantly longer distances without being susceptible to noise as compared to an analog transmission over the same distance. In some embodiments, integrated circuit 105 may be disposed in close proximity with analog signal source 101 to ensure that the length of the analog line between analog signal source 101 and integrated circuit 105 is relatively short to minimize the amount of noise that can be picked up on an analog output line carrying analog input signal ANALOG_IN. For example, in some embodiments, analog signal source 101 and integrated circuit 105 may be formed on the same substrate. In other embodiments, analog signal source 101 and integrated circuit 105 may be formed on different substrates packaged within the same integrated circuit package.

Digital processor 109 may comprise any suitable system, device, or apparatus configured to process digital output signal for use in a digital system. For example, digital processor 109 may comprise a microprocessor, microcontroller, digital signal processor (DSP), application specific integrated circuit (ASIC), or any other device configured to interpret and/or execute program instructions and/or process data, such as digital output signal DIGITAL_OUT.

Data acquisition system 100 may be used in any application in which it is desired to process an analog signal to generate a digital signal. Thus, in some embodiments, data acquisition system 100 may be integral to an audio device that converts analog signals (e.g., from a microphone or sensor) to digital signals equivalent to the analog signals. As another example, data acquisition system 100 may be integral to a radio-frequency device (e.g., a mobile telephone) to convert radio-frequency analog signals into digital signals.

Figure 2:
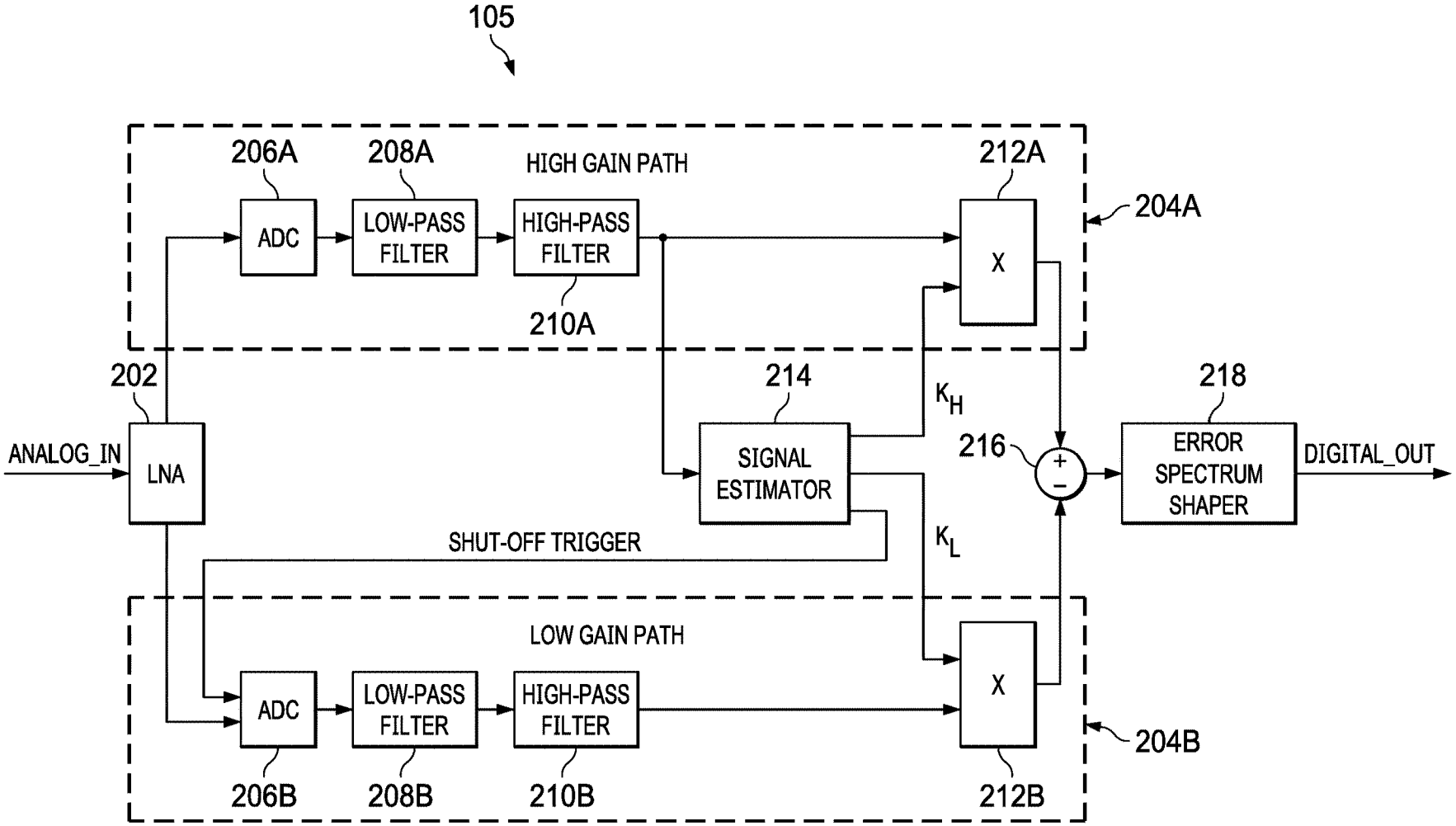
FIG. 2 illustrates a block diagram of selected components of an integrated circuit for processing an analog signal to generate a digital signal, in accordance with embodiments of the present disclosure.

FIG. 2 illustrates a block diagram of selected components of integrated circuit 105, in accordance with embodiments of the present disclosure. As shown in FIG. 2, integrated circuit 105 may include two or more data paths including a high-gain path 204A and a low-gain path 204B (which may be referred to herein individually as a data path 204 and collectively as data paths 204).

Each data path may receive analog input signal ANALOG_IN as conditioned by a low-noise amplifier (LNA) 202. LNA 202 may comprise an electronic amplifier configured to amplify a very low-power signal (e.g., analog input signal ANALOG_IN) without significantly degrading its signal-to-noise ratio.

Each data path 204 may include a respective analog-to-digital (ADC) converter 206 (e.g., ADC 206A, ADC 206B), a respective low-pass filter 208 (e.g., low-pass filter 208A, low-pass filter 208B), a respective high-pass filter 210 (e.g., high-pass filter 210A, high-pass filter 210B), and a respective multiplier 212 (e.g., multiplier 212A, multiplier 212B).

An ADC 206 may comprise any suitable system, device, or apparatus configured to convert an analog signal received at its input, to a digital signal representative of analog input signal ANALOG_IN. ADC 206 may itself include one or more components (e.g., delta-sigma modulator, decimator, etc.) for carrying out the functionality of ADC 206.

Each low-pass filter 208 may low-pass a digital signal generated by its associated ADC 206, which may filter out high-frequency noise caused by signal harmonics, signal aliasing, and/or noise inherent in components of integrated circuit 105. In turn, each high-pass filter 208 may high-pass filter a digital signal generated by its associated digital gain element, for example to filter out any direct-current offsets present in the digital signal generated by ADCs 206.

Each multiplier 212 may apply a respective multiplicative constant (e.g., $K_H$ for multiplier 212A and $K_L$, for multiplier 212B). Together with combiner 216, multipliers 212 may blend the digital signals generated by high-gain path 204A and low-gain path 204B based on a signal magnitude of analog input signal ANALOG_IN determined by signal estimator 214. Thus, based on a signal magnitude of analog input signal ANALOG_IN, multipliers 212 and combiner 216 may effectively select the digital signal generated by high-gain path 204A as an output signal, select the digital signal generated by low-gain path 204B as the output signal, or select a blend of the digital signal generated by high-gain path 204A and the digital signal generated by low-gain path 204B as the output signal.

A digital error spectrum shaper 218 may modulate (e.g., into a one-bit serial signal) the blended signal generated by combiner 216 to generate digital output signal DIGITAL_OUT.

Also as shown in FIG. 2 and described in greater detail below, signal estimator 214 may generate a shut-off trigger signal which may cause selective enabling or disabling (e.g., powering down) of low-gain path 204B, for example when high-gain path 204A is selected for outputting the output signal.

While described in more detail below, signal estimator 214 may comprise a level detector configured to detect an amplitude of analog input signal ANALOG_IN or a signal derivative thereof (e.g., a signal present at the output of high-pass filter 210A) and based thereon, generate multiplicative factors $K_H$ and $K_L$ and the shut-off trigger signal.

The data paths 204 may be either identical or different in terms of noise and signal input range. For example, in a microphone or codec, one path may be optimized for noise (e.g., high-gain path 204A) while the other path may be optimized for a large signal (e.g., low-gain path 204B). Accordingly, signal estimator 214 may detect an amplitude of analog input signal ANALOG_IN and switch between the data paths based on the amplitude. Switching from high-gain path 204A to low-gain path 204B may need to occur as fast as possible to prevent extended clipping of analog input signal ANALOG_IN, while switching from low-gain path 204B to high-gain path 204A may happen relatively slowly.

Thus, to minimize power consumption, low-gain path 204B may be turned off when analog input signal ANALOG_IN is smaller than a threshold where about such threshold the output of high-gain path 204A is blended into the output of high-gain path 204A (e.g., where $K_L$=0). Similarly, high-gain path 204A may be turned off when analog input signal ANALOG_IN is large enough that the output of high-gain path 204A is not being blended with the output of low-gain path 204B (e.g., where $K_H$=0). When a data path 204 is turned off, its ADC 206 and other relevant portions of the digital signal processing of such data path 204 may be powered down in order to provide glitch-less power savings. Further, in some embodiments, LNA 202 may also be turned off and bypassed if a glitch is acceptable in a particular application.

Figure 3:
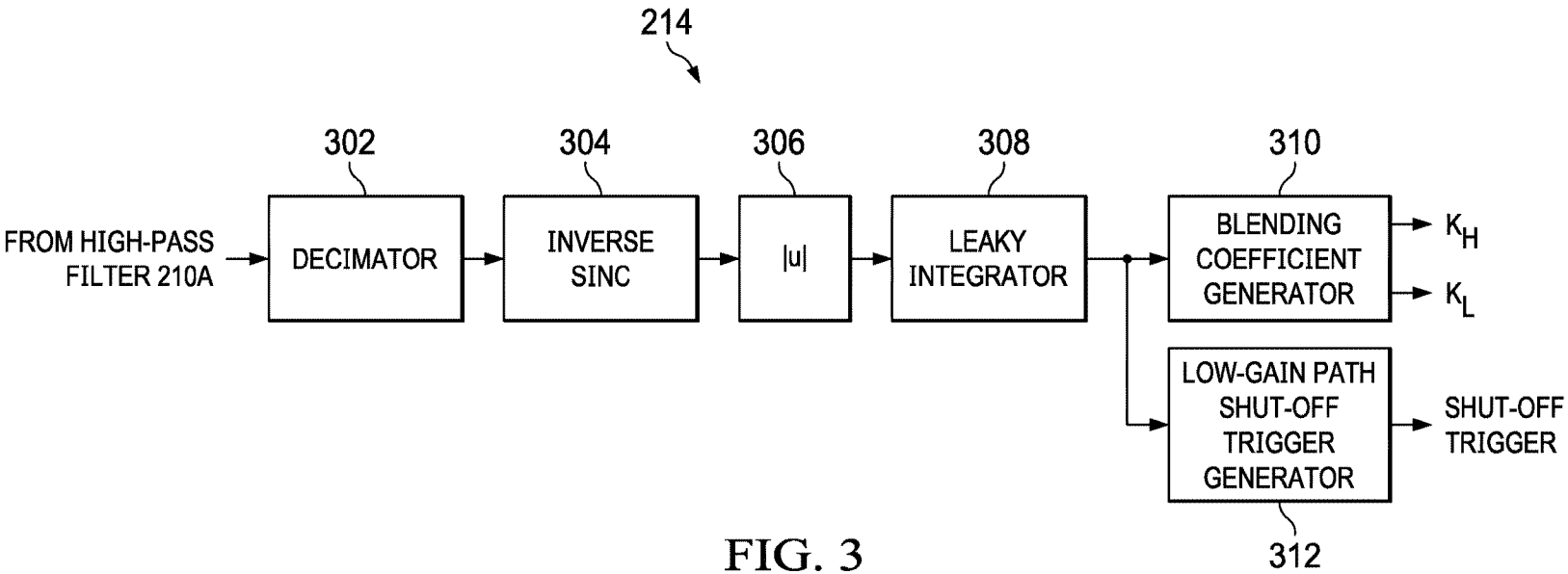
FIG. 3 illustrates a block diagram of selected components of a signal estimator, in accordance with embodiments of the present disclosure.

FIG. 3 illustrates a block diagram of selected components of a signal estimator 214, in accordance with embodiments of the present disclosure. As shown in FIG. 3, the digital output signal generated by high-gain path 204A may be decimated by decimator 302. In some embodiments, decimator 302 may comprise a cascaded integrator-comb (CIC) decimator which decimates the signal by a factor of 16. An inverse sinc filter 304 may apply a droop correction to the decimated signal. An absolute value block 306 may take the absolute value of the output of inverse sinc filter 304, and a leaky integrator 308 may, based on such absolute value, generate a signal that is indicative of the peak of analog input signal ANALOG_IN. Based on such peak value, a blending coefficient generator 310 may generate multiplicative factors $K_H$ and $K_L$. Further, a low-gain path shut-off trigger generator 312 may generate the shut-off trigger signal based on a comparison of such peak value to a threshold.

Figure 4:
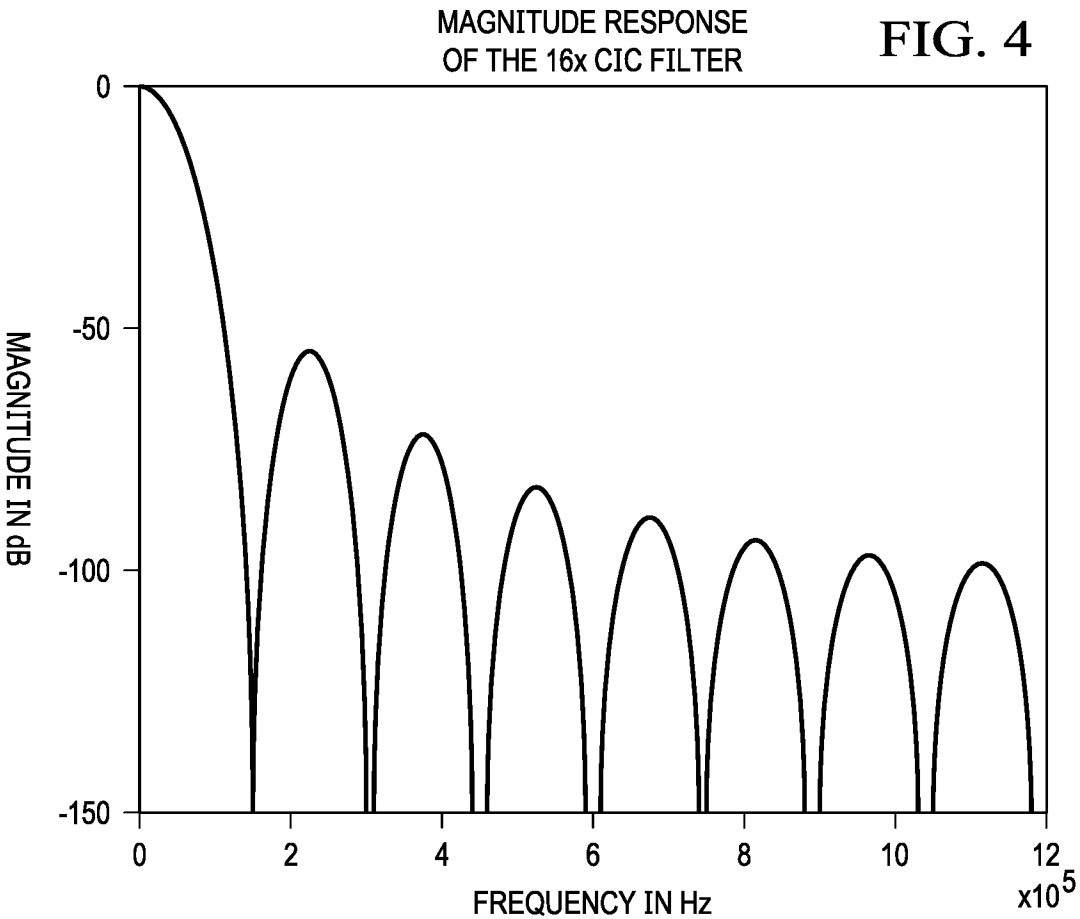
FIG. 4 illustrates an example magnitude response of a cascaded integrator-comb filter with a decimation factor of 16, in accordance with embodiments of the present disclosure.
Figure 5:
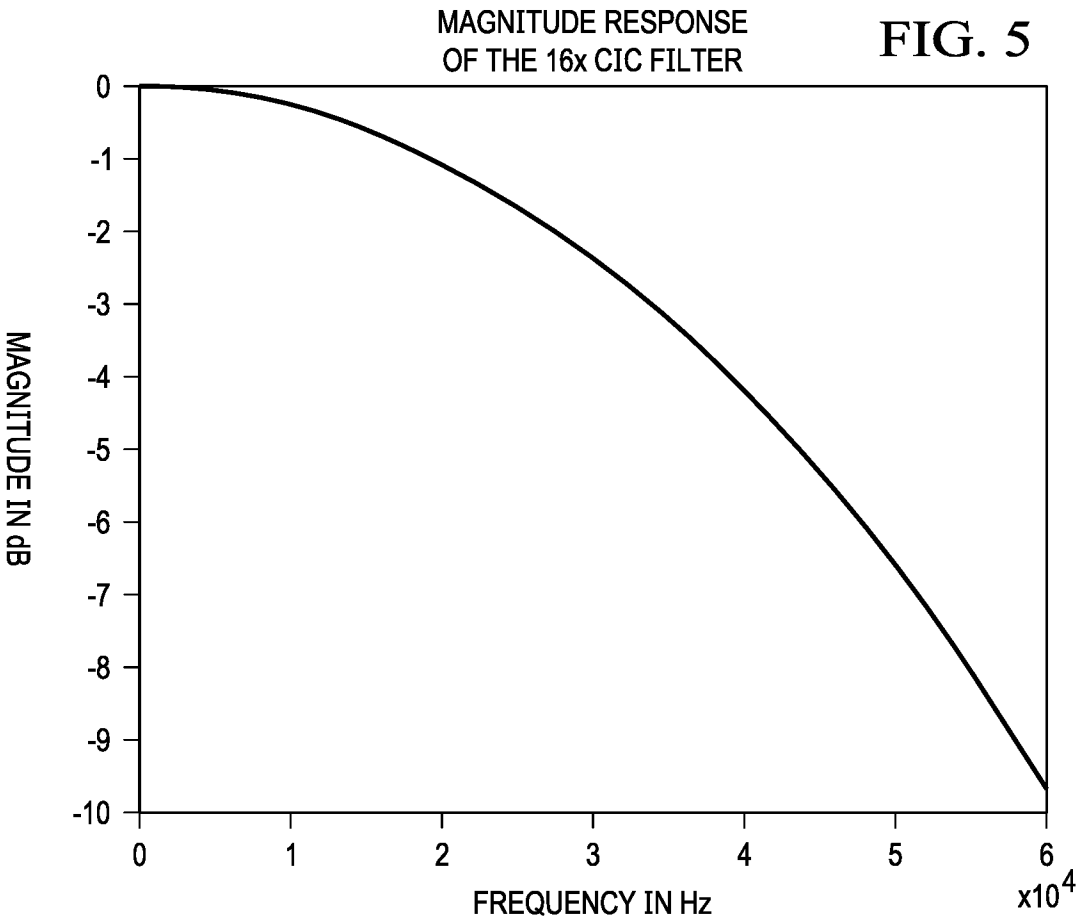
FIG. 5 illustrates an example magnitude response of a cascaded integrator-comb filter with a decimation factor of 16, within a signal passband, in accordance with embodiments of the present disclosure.

Decimation of the digital signal generated by high-gain path 204A using decimator 302 may enable processing of the signal at as low a rate as possible without drastically disturbing its integrity. For example, the digital signal received by signal estimator 214 may have a useful bandwidth of 60 kHz (i.e., 20 kHz of audio frequencies and 30 kHz-60 kHz of ultrasonic frequencies). The sampling rate of ADC 206A in a high-power mode may be 2.4 MHz. A decimation by a factor of 15 results in a sampling rate of 160 kHz which may be safe enough to allow the ultrasonic frequencies without any attenuation. The structure of decimator 302 needed in order to decimate by 15, however, may have to be implemented using a standard architecture. Such an option, when the area and power are to be minimized, may not be desirable. However, a CIC decimator may be used in an efficient implementation when the decimation factor is a power of two. The nearest power-of-two decimation factor to 15 is 16. However, such a decimation factor of 16 may attenuate the signal in the region around the ultrasonic frequencies, as shown in FIG. 4. FIG. 5 shows that the droop of the magnitude response of decimator 302 implemented as a CIC decimator with a decimation factor of 16 is near the ultrasonic frequencies.

Inverse sinc filter 304, which may be implemented as an infinite impulse response filter, may compensate for such droop of the magnitude response of decimator 302. For example, in some embodiments, a filter response of inverse sinc filter 304 may be given by:

$$H_{CIC}(z) = \frac{-1.85938 + 0.25z^{-1}}{1 + 0.640625z^{-1}}$$

Figure 6:
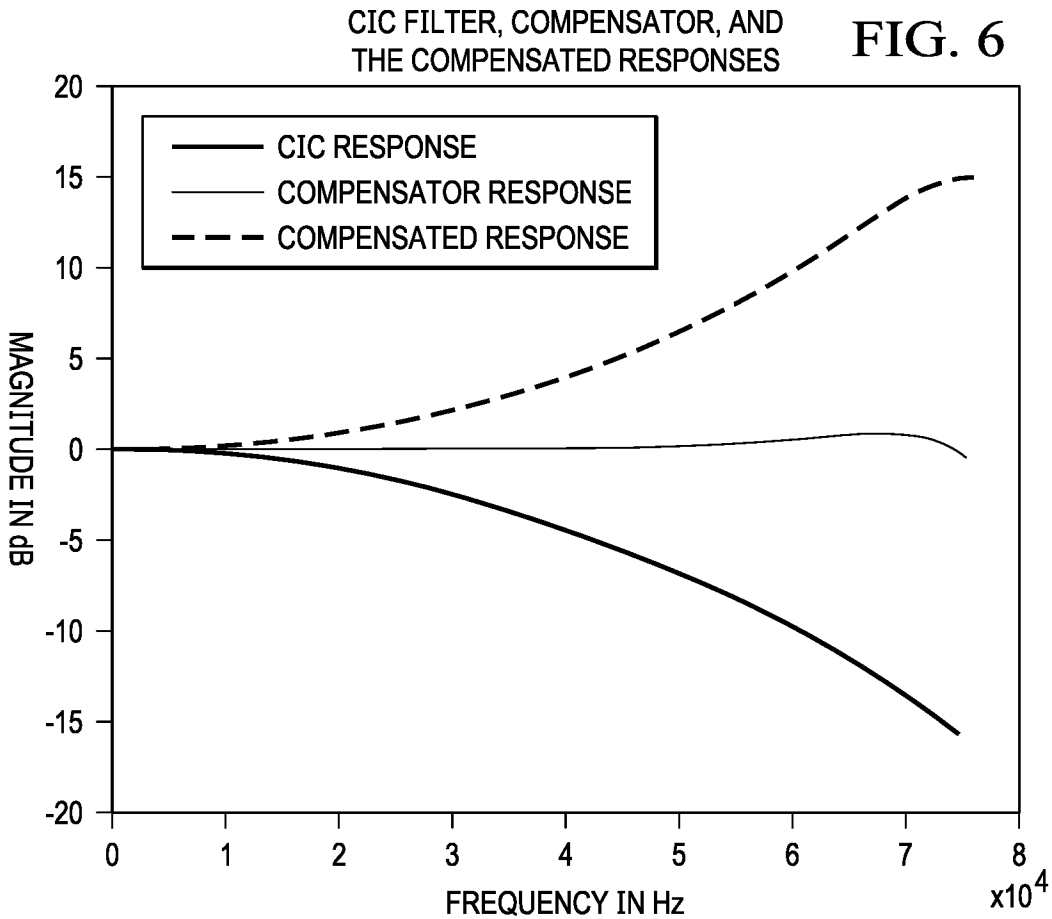
FIG. 6 illustrates example magnitude responses of a cascaded integrator-comb filter with a decimation factor of 16 and an inverse sinc filter, and a combined response of both filters, in accordance with embodiments of the present disclosure.

FIG. 6 illustrates an example magnitude response of decimator 302 implemented as a CIC filter with a decimation factor of 16, an example magnitude response of inverse sinc filter 304, and a combined response of both filters to compensate for droop, in accordance with embodiments of the present disclosure.

Figure 7:
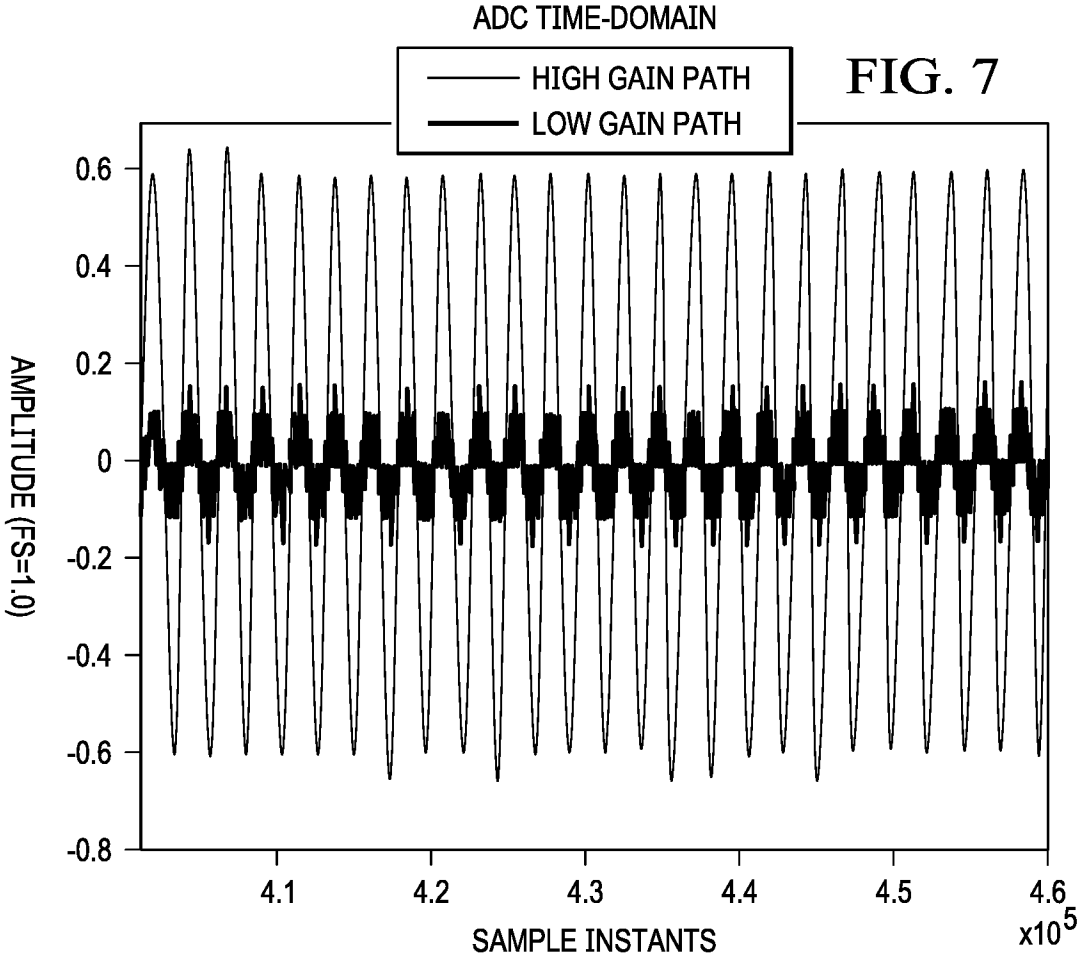
FIG. 7 illustrates example outputs of analog-to-digital converters for a sinusoid of an analog input signal 30 decibels below full scale and 1 kHz frequency, in accordance with embodiments of the present disclosure.

FIG. 7 illustrates example outputs of ADCs 206 for a sinusoid of analog input signal ANALOG_IN 30 decibels below full scale (which may correspond to 100 decibels of sound pressure level) and 1 kHz frequency, in accordance with embodiments of the present disclosure. As can be seen from FIG. 7, sinusoidal signal may not be well defined to the outputs of ADCs 206. Such lack of sinusoidal definition may be due to the fact that each ADC 206 may only have a limited number of levels to represent a signal (e.g., 10 levels). In order to obtain a true peak of the signal, such signal may require filtering by a low-pass filter, which may act as a smoothing filter. The low-pass nature of a CIC decimator, which may be used to implement decimator 302, may perform this low-passing filtering and smoothing function, in addition to reducing the sampling rate of the signal.

Figure 8:
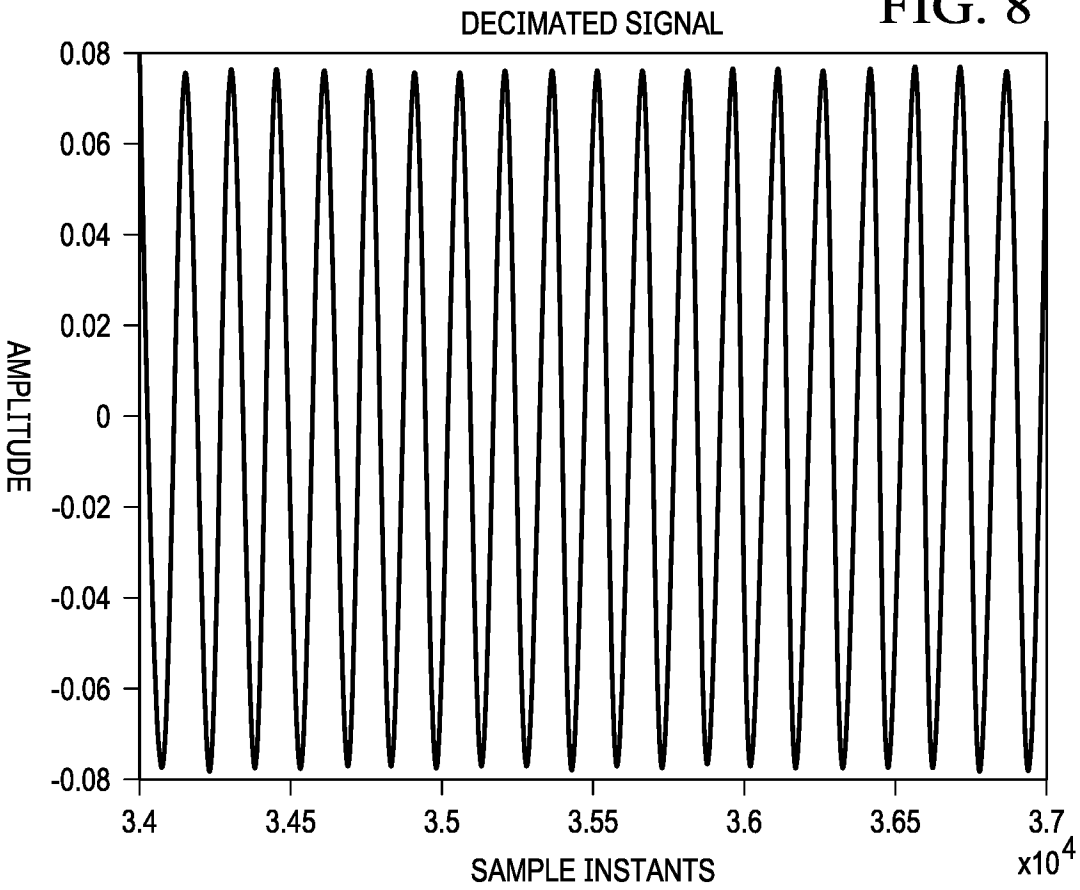
FIG. 8 illustrates a corresponding decimated signal after droop correction in response to a sinusoid of analog input signal 30 decibels below full scale and 1 kHz frequency, in accordance with embodiments of the present disclosure.

FIG. 8 illustrates a corresponding decimated signal after droop correction in response to a sinusoid of analog input signal ANALOG_IN 30 decibels below full scale (which may correspond to 100 decibels of sound pressure level) and 1 kHz frequency, in accordance with embodiments of the present disclosure. As may be seen from FIG. 8, the output of decimator 302 may be well-defined and may facilitate peak detection.

Figure 9:
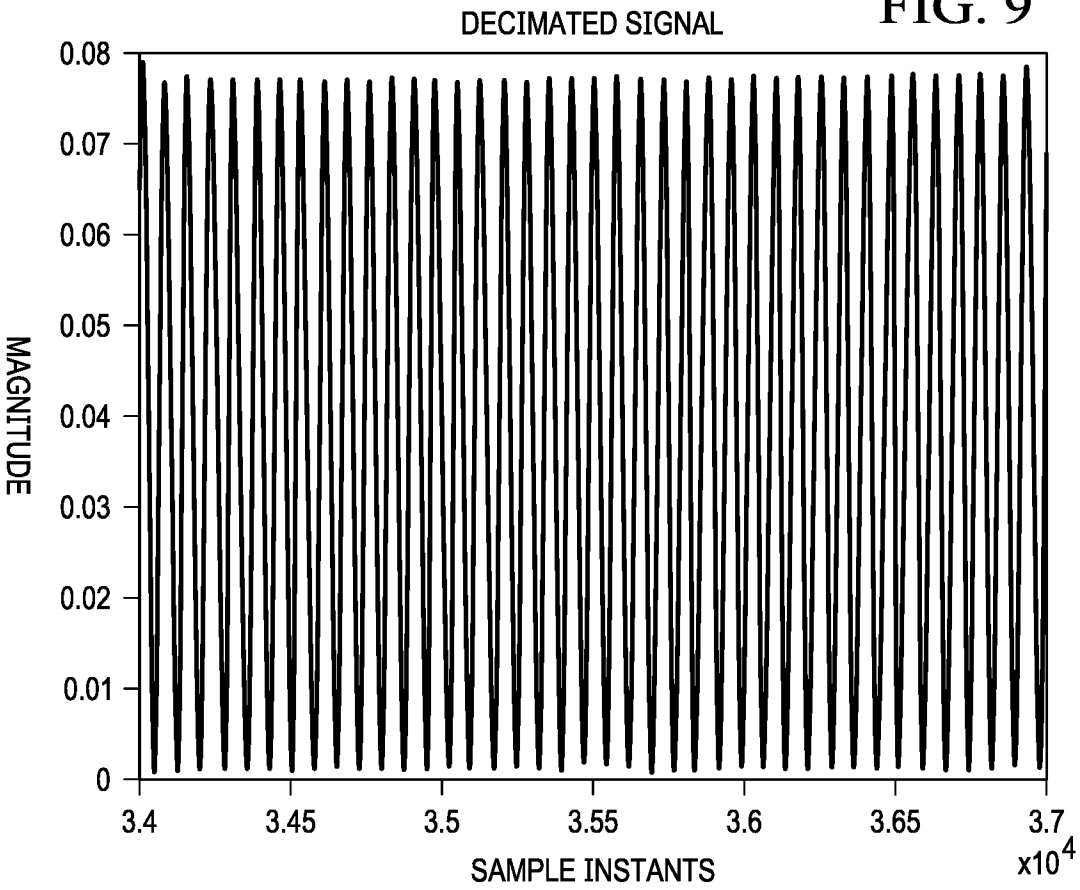
FIG. 9 illustrates an absolute value of the signal of FIG. 8, in accordance with embodiments of the present disclosure.
Figure 10:
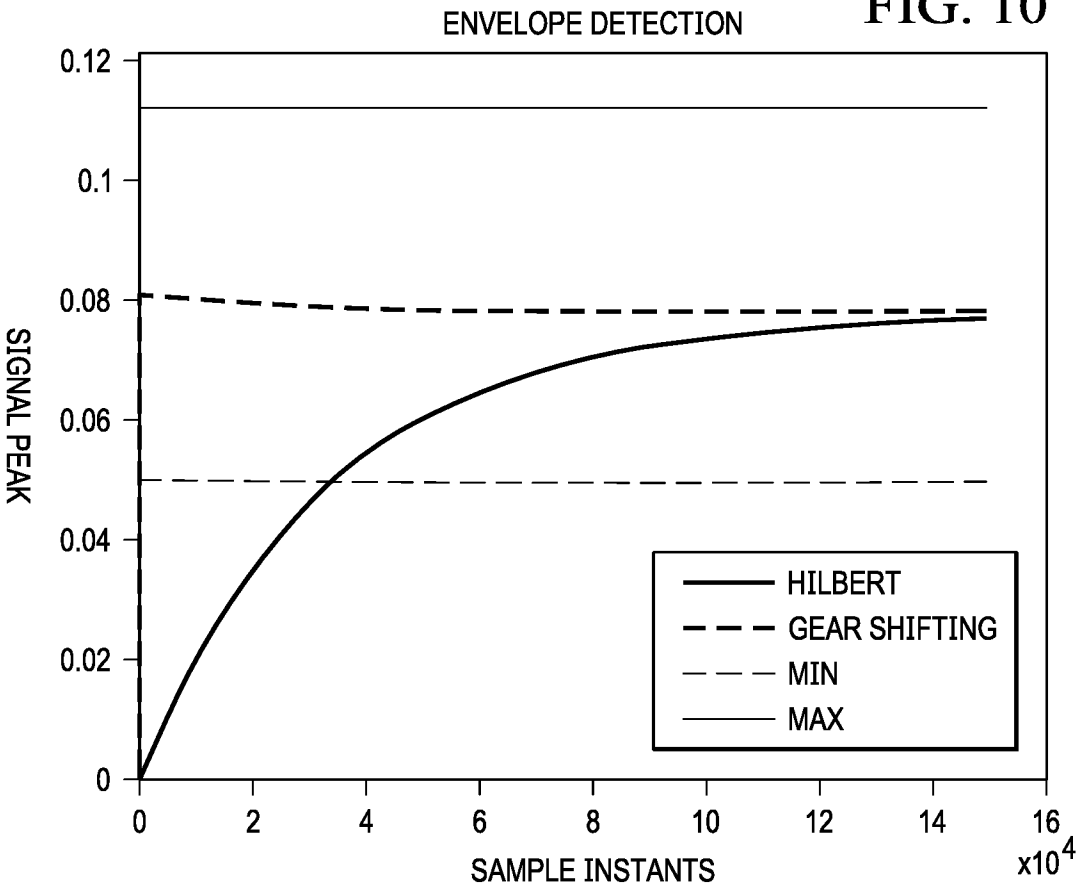
FIG. 10 illustrates peak detection using a gear-shifting leaky integrator approach as compared to use of a Hilbert filter, in accordance with embodiments of the present disclosure.

As described above, absolute value block 306 may generate the absolute value of the output of inverse sinc filter 304. FIG. 9 illustrates an example of absolute value block 306 applied to the signal of FIG. 8, in accordance with embodiments of the present disclosure. From FIG. 9, it may be seen that the absolute value of the decimated signal is very similar to full-wave rectification in an alternating-current (AC) to direct-current (DC) conversion process. To obtain the DC component, which may be indicative of the peak signal level, leaky integrator 308 may be applied to the output of absolute value block 306. Leaky integrator 308 may be designed such that it tracks a signal increasing in magnitude very quickly, while tracking a signal decreasing in magnitude very slowly (e.g., equivalent to a slow discharge from a capacitor). To perform such functionality, leaky integrator 308 may employ the concept of gear shifting, wherein the bandwidth of the leaky integrator is increased when the signal is increasing quickly (which may be indicative of the peak), and the peak may be retained by decreasing bandwidth of leaky integrator 308. FIG. 10 illustrates peak detection using a gear-shifting leaky integrator approach as compared to use of a Hilbert filter, in accordance with embodiments of the present disclosure. Also depicted in FIG. 10 are threshold values "Min" and "Max," wherein "Min" may correspond to a threshold signal peak below which low-gain path 204B may not contribute to the blended digital output signal of integrator circuit 105, and "Max" may correspond to a threshold signal peak above which high-gain path 204A may not contribute to the blended digital output signal of integrator circuit 105. Blending of the data paths 204 may occur between the thresholds "Min" and "Max."

Figure 11:
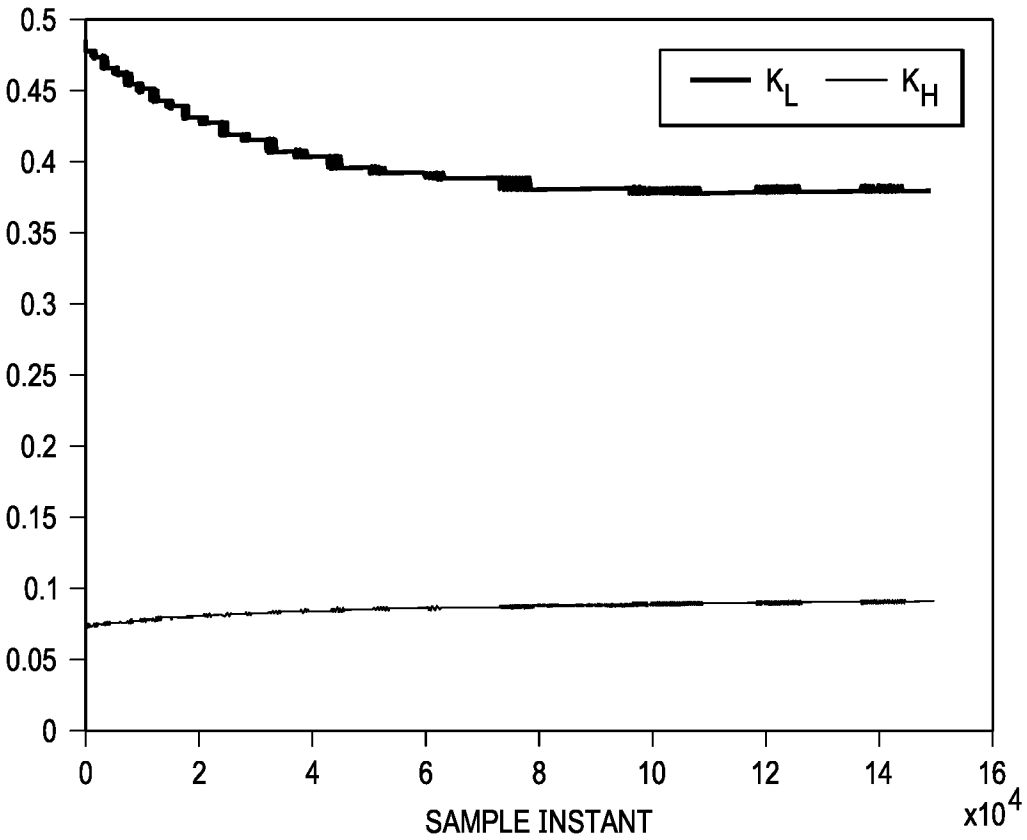
FIG. 11 illustrates variance of multiplicative factors used for blending of the outputs of data paths, in accordance with embodiments of the present disclosure.

FIG. 11 illustrates variance of multiplicative factors $K_H$ and $K_L$ used for blending of the outputs of data paths 204, in accordance with embodiments of the present disclosure. Factors $K_H$ and $K_L$ may add to unity after taking into account a factor G representing the difference in gain between high-gain path 204A and low-gain path 204B (e.g., $K_H$ $GK_L$=1).

Figure 12:
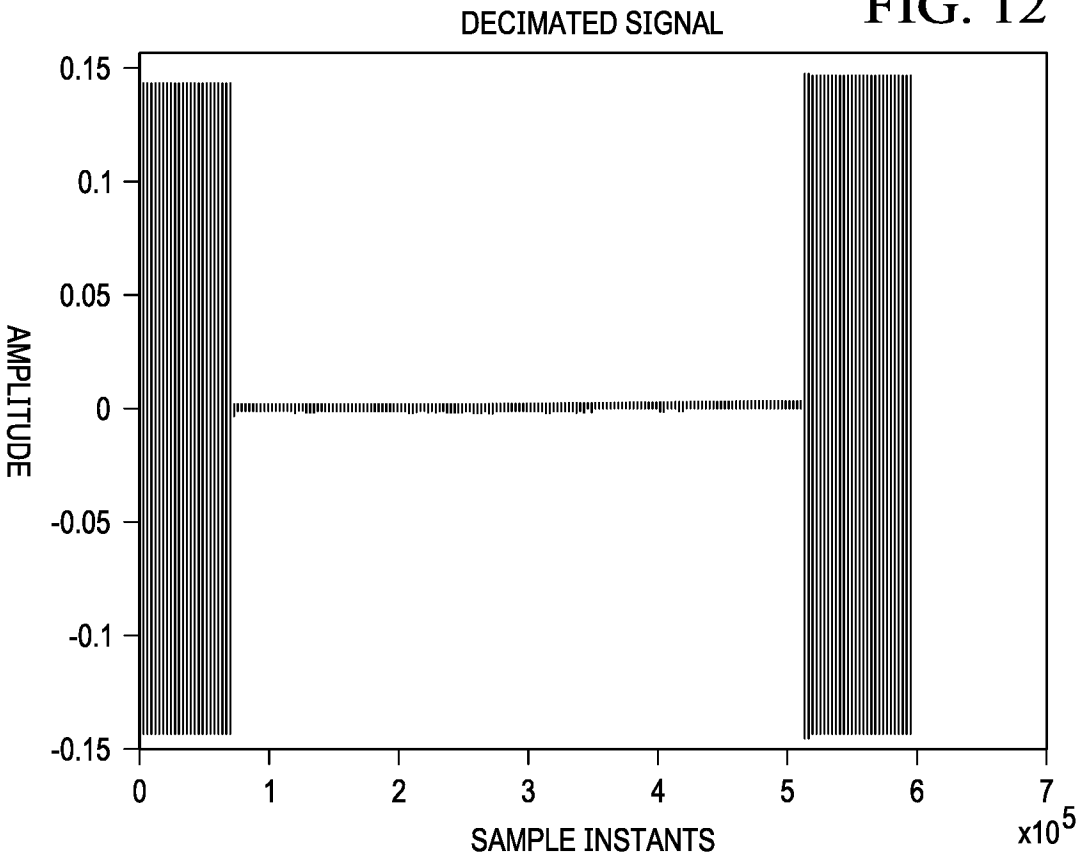
FIG. 12 illustrates an example decimated signal, in accordance with embodiments of the present disclosure.
Figure 13:
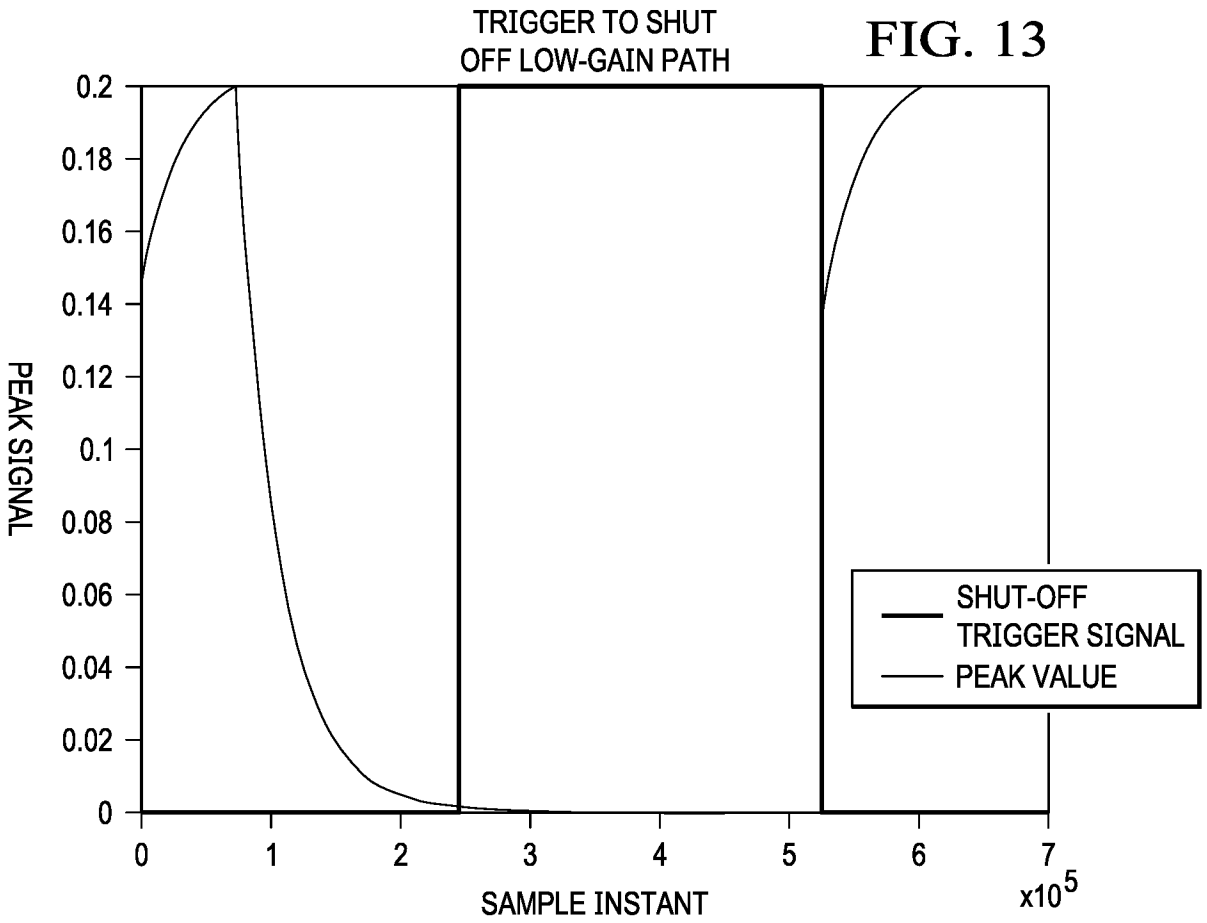
FIG. 13 illustrates a peak value determined by a leaky integrator shut-off trigger signal that may result from the decimated signal shown in FIG. 12, in accordance with embodiments of the present disclosure.

As described above, in order to minimize power consumption, integrated circuit 105 may be configured to shut off or power down low-gain path 204B or portions thereof when analog input signal ANALOG_IN is below a particular threshold magnitude. Because signal estimator 214 may determine a peak value of the signal, low-gain path shut-off trigger generator 312 may implement a finite state machine to monitor such peak value for a period of time. If the signal is below a threshold magnitude for the entire period of time, low-gain path shut-off trigger generator 312 may enable the shut-off trigger signal, which may shut off low-gain path 204B or portions thereof. On the other hand, if the signal rises above the threshold magnitude during any portion of the period of time, low-gain path shut-off trigger generator 312 may disable the shut-off trigger signal, thus leaving low-gain path 204B powered on. To demonstrate this functionality, FIG. 12 illustrates an example decimated signal, in accordance with embodiments of the present disclosure, while FIG. 13 illustrates a peak value determined by leaky integrator 308 and the shut-off trigger signal that may result from the decimated signal shown in FIG. 12, in accordance with embodiments of the present disclosure.

From FIGS. 12 and 13, it may be seen that when the peak value falls below a particular threshold, low-gain path shut-off trigger generator 312 may generate the shut-off trigger signal. In response, low-gain path 204B or portions thereof may power down until low-gain path shut-off trigger generator 312 disables the shut-off trigger signal.

Furthermore, while signal estimator 214 may estimate a peak of the signal, the decision on the multiplicative factors $K_H$ and $K_L$ of blending may be based on separate estimates of direct current (DC) and the signal peak. Thus, the thresholds for blending may be variably controlled in some embodiments. Although embodiments of the present disclosure show the shutting off or deactivation of one of the data paths based on a detected peak value, a number of other metrics/values, such as, Root-Mean-Square (RMS) value, mean value, variance, standard deviation, moments, cumulants, etc., may be used instead of or in addition to those discussed herein.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A method for minimizing power consumption in a data acquisition system having a plurality of data paths including a first data path and a second data path, the method comprising:

receiving an input signal for the data acquisition system;

determining a magnitude of the input signal by detecting a peak value of the input signal, wherein detecting the peak value comprises passing the input signal or a signal derived from the input signal through a leaky integrator; and dynamically deactivating one of the first and second data paths based on the detected peak value.

2. The method of claim 1, wherein the leaky integrator is designed to track an increasing input signal significantly quicker than it tracks a decreasing input signal.

3. The method of claim 2, further comprising:

increasing a bandwidth of the leaky integrator when the input signal quickly increases such that an output of the leaky integrator is indicative of the peak value; and retaining the peak value by decreasing the bandwidth of the leaky integrator.

4. A data acquisition system, comprising:

an input for receiving an input signal for the data acquisition system;

a plurality of data paths including a first data path and a second data path; and a signal estimator configured to:

determine a magnitude of the input signal by detecting a peak value of the input signal, wherein detecting the peak value comprises passing the input signal or a signal derived from the input signal through a leaky integrator; and dynamically deactivate one of the first and second data paths based on the detected peak value.

5. The data acquisition system of claim 4, wherein the leaky integrator is designed to track an increasing input signal significantly quicker than it tracks a decreasing input signal.

6. The data acquisition system of claim 5, wherein the signal estimator is further configured to:

increase a bandwidth of the leaky integrator when the input signal quickly increases such that an output of the leaky integrator is indicative of the peak value; and retain the peak value by decreasing the bandwidth of the leaky integrator.

7. A system for minimizing power consumption in a data acquisition system having a plurality of data paths including a first data path and a second data path, the system comprising:

an input for receiving an input signal for the data acquisition system; and a signal estimator configured to:

determine a magnitude of the input signal using estimation of the input signal by detecting a peak value of the input signal, wherein detecting the peak value comprises passing the input signal or a signal derived from the input signal through a leaky integrator; and dynamically deactivate one of the first and second data paths based on the detected peak value.

8. The system of claim 7, wherein the leaky integrator is designed to track an increasing input signal significantly quicker than it tracks a decreasing input signal.

9. The system of claim 8, wherein the signal estimator is further configured to:

increase a bandwidth of the leaky integrator when the input signal quickly increases such that an output of the leaky integrator is indicative of the peak value; and retain the peak value by decreasing the bandwidth of the leaky integrator.

* * * * *